US007458409B1

(12) United States Patent
Sadowski

(10) Patent No.: US 7,458,409 B1
(45) Date of Patent: Dec. 2, 2008

(54) CORNICE SYSTEM

(76) Inventor: Nancy C. Sadowski, 222 Ivory Dr., Melbourne Beach, FL (US) 32951

( * ) Notice: Subject to any disclaimer, the term of this patent is extended or adjusted under 35 U.S.C. 154(b) by 227 days.

(21) Appl. No.: 11/496,212

(22) Filed: Jul. 31, 2006

(51) Int. Cl.
*E06B 9/00* (2006.01)

(52) U.S. Cl. ..... 160/38; 160/348

(58) Field of Classification Search ..... 160/38, 160/39, 19, 330, 348; 428/4, 5
See application file for complete search history.

(56) References Cited

U.S. PATENT DOCUMENTS

| | | | | | |
|---|---|---|---|---|---|
| 1,922,170 | A * | 8/1933 | McGarry | 160/327 |
| 2,430,959 | A * | 11/1947 | Soff | 160/38 |
| 2,803,298 | A * | 8/1957 | Schlesinger | 160/349.1 |
| 2,862,549 | A * | 12/1958 | Robbins | 160/38 |
| 2,998,062 | A * | 8/1961 | Bixby | 160/39 |
| 3,996,987 | A * | 12/1976 | Rodriguez | 160/19 |
| 4,246,951 | A * | 1/1981 | Givens | 160/39 |
| 5,033,525 | A * | 7/1991 | Paeselt | 160/39 |
| 5,042,549 | A * | 8/1991 | Roberts | 160/39 |
| 5,074,348 | A * | 12/1991 | Phillips | 160/38 |
| 5,154,218 | A * | 10/1992 | Subecz | 160/330 |
| 5,159,965 | A * | 11/1992 | Roy et al. | 160/38 |
| 5,505,245 | A * | 4/1996 | Badalamenti | 160/38 |
| 5,673,741 | A * | 10/1997 | Cairns | 160/330 |
| 5,890,527 | A * | 4/1999 | Smiley et al. | 160/39 |
| 6,085,821 | A * | 7/2000 | Roberts | 160/38 |
| 6,152,204 | A * | 11/2000 | Santoro | 160/38 |
| 6,192,962 | B1 * | 2/2001 | Glover | 160/126 |
| 2004/0216850 | A1 * | 11/2004 | Zorbas et al. | 160/38 |
| 2005/0199356 | A1 * | 9/2005 | Nien et al. | 160/348 |

* cited by examiner

*Primary Examiner*—David Purol
(74) *Attorney, Agent, or Firm*—Louis J. Brunoforte

(57) ABSTRACT

A cornice box has a horizontally disposed upper panel and a vertically disposed forward panel and vertically disposed laterally spaced left and right side panels. Each panel is rectangular and has an exterior surface and an interior surface. A fabric cover has a central section positionable over the exterior surface of the forward panel and end sections positionable over the exterior surfaces of the side panels. The fabric cover has a periphery sized to extend beyond the exterior surfaces of the front and side panels on all sides with fasteners positioned through the fabric cover adjacent to its periphery into the panels.

2 Claims, 4 Drawing Sheets

FIG 1
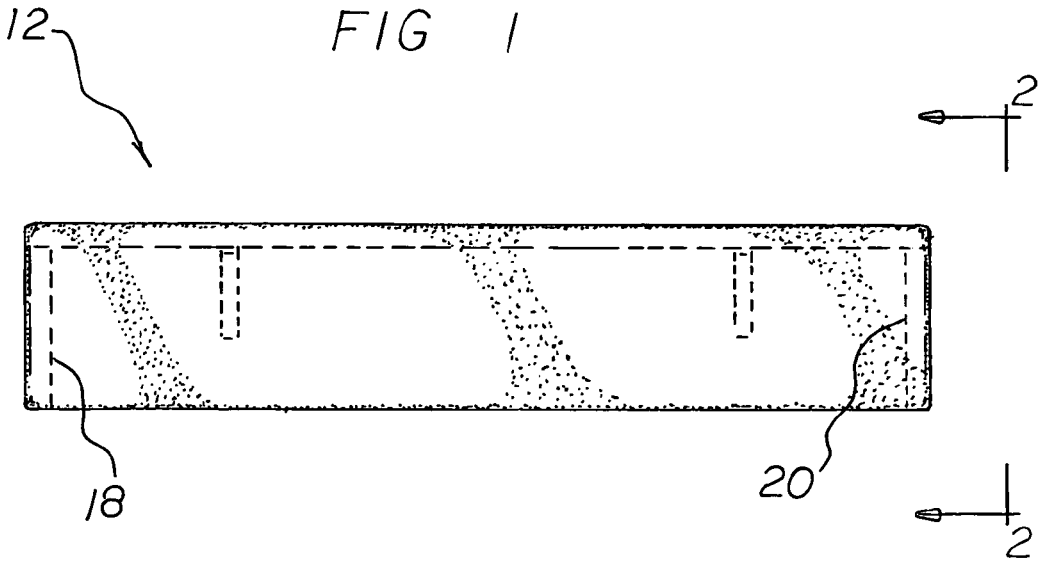
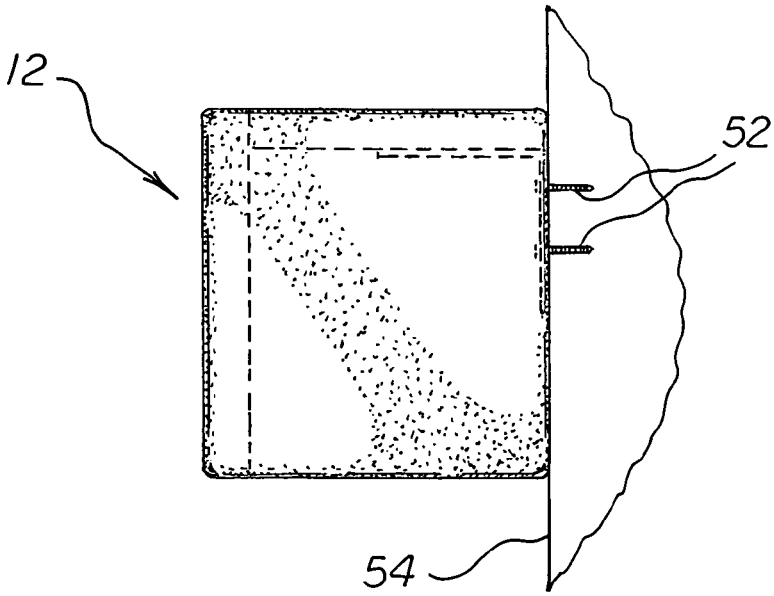
FIG 2

FIG 5
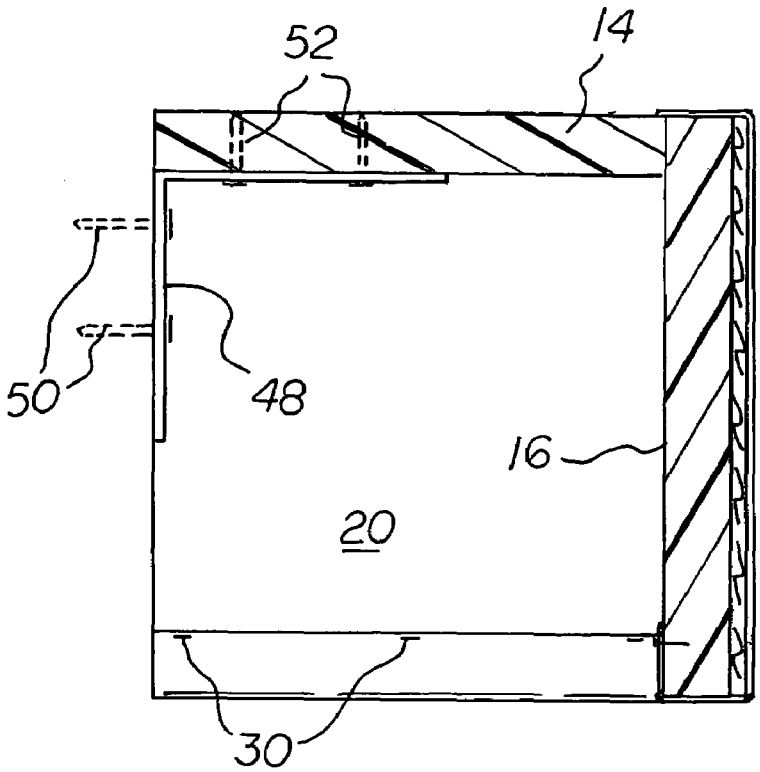
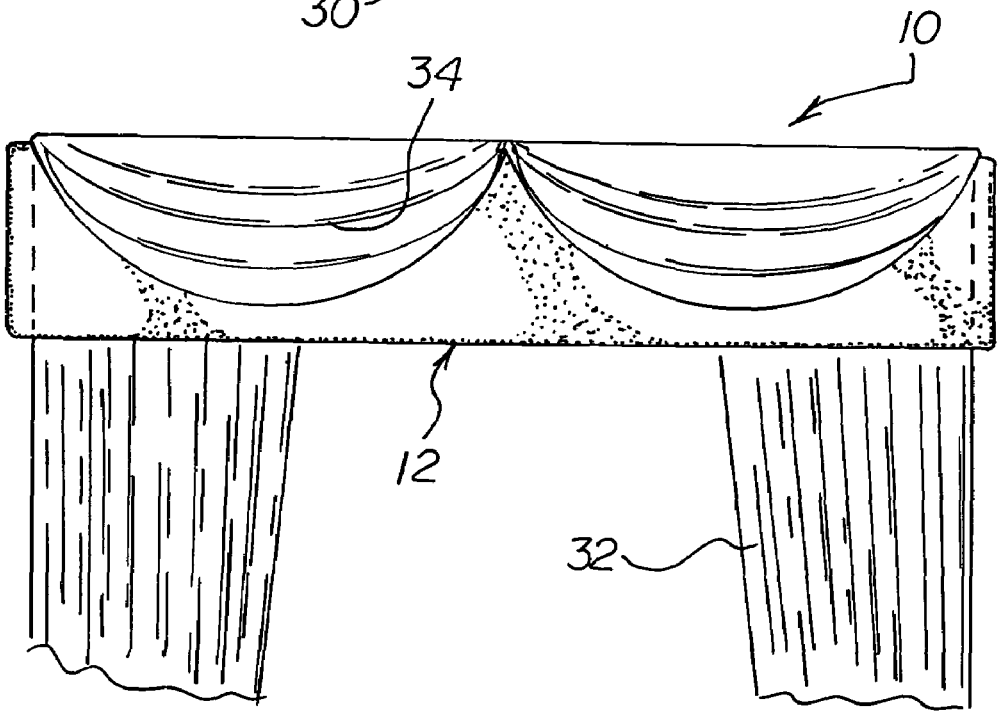
FIG 6

FIG 7
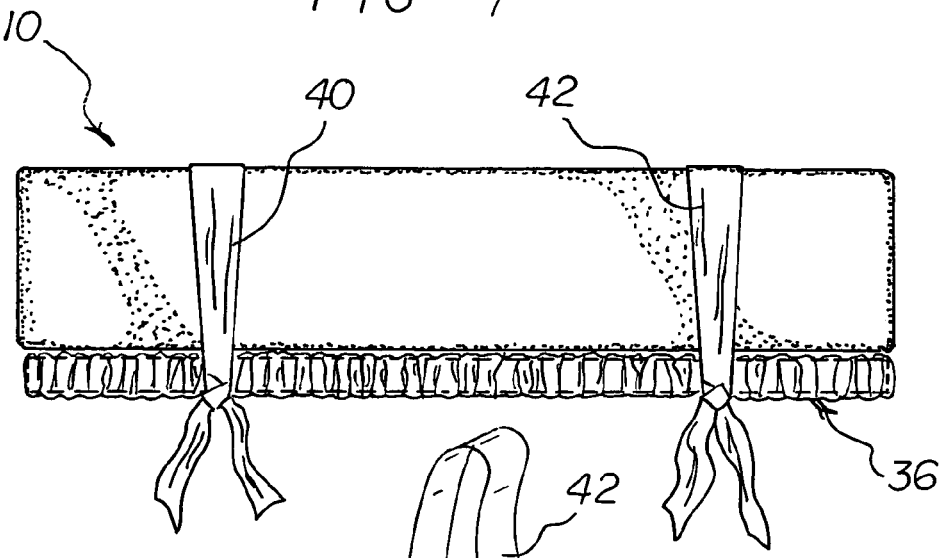
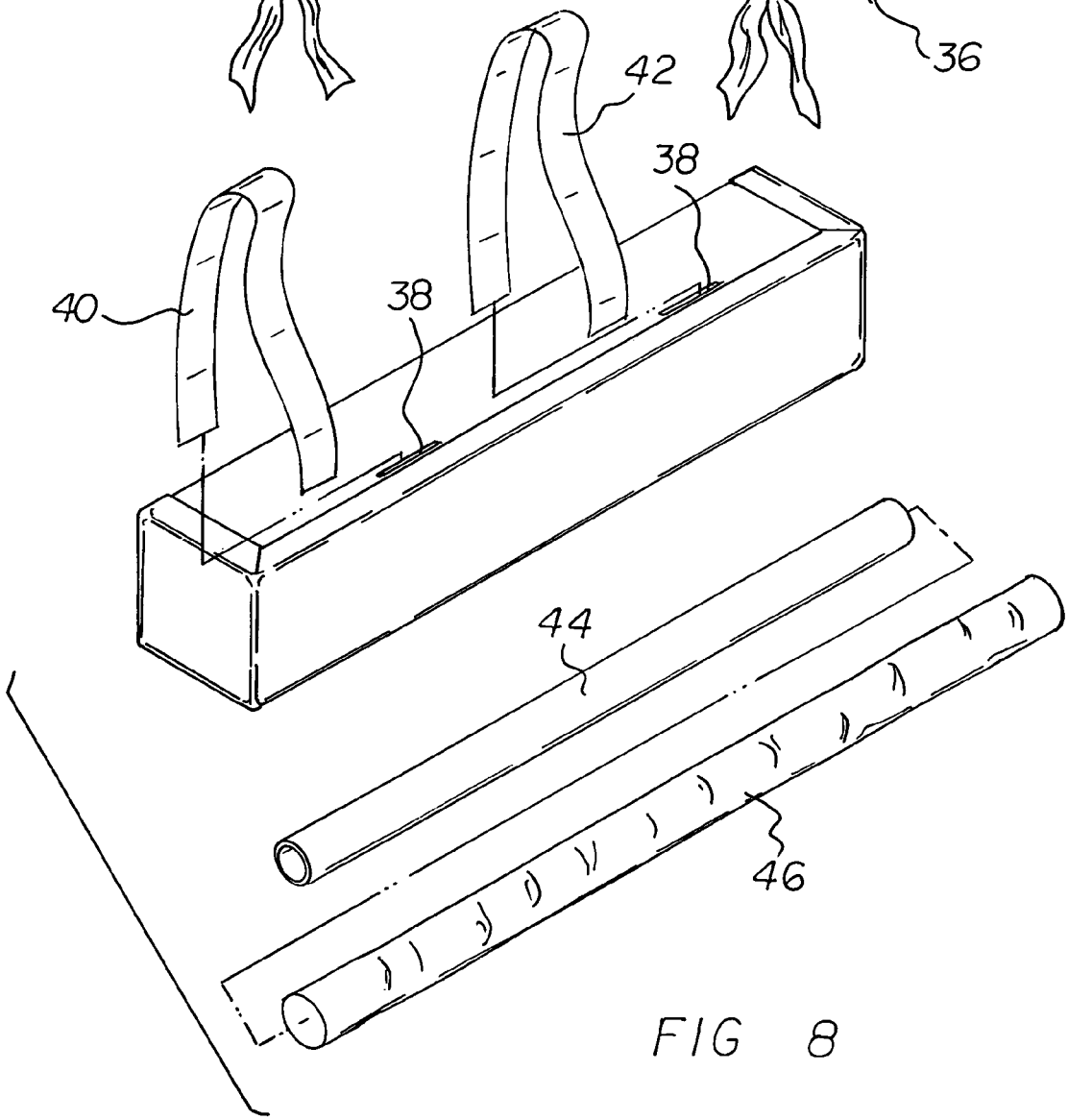
FIG 8

CORNICE SYSTEM

BACKGROUND OF THE INVENTION

1. Field of the Invention

The present invention relates to a cornice system and more particularly pertains to hiding a curtain rod and creating a decorative appearance.

2. Description of the Prior Art

The use of decorative cornices is known in the prior art. More specifically, decorative cornices previously devised and utilized for the purpose of hiding curtain rods and creating decorative appearances are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,927,362 issued Jul. 27, 1999 to Smiley relates to a Window Cornice Assembly. U.S. Pat. No. 6,152,204 issued Nov. 28, 2000 to Santoro relates to a Decorative Cornice. Lastly, U.S. Pat. No. 6,155,523 issued Dec. 5, 2000 relates to a Magnetic Base Holder.

While these devices fulfill their respective, particular objectives and requirements, the aforementioned patents do not describe a cornice system that allows hiding a curtain rod and creating a decorative appearance.

In this respect, the cornice system according to the present invention substantially departs from the conventional concepts and designs of the prior art, and in doing so provides an apparatus primarily developed for the purpose of hiding a curtain rod and creating a decorative appearance.

Therefore, it can be appreciated that there exists a continuing need for a new and improved cornice system which can be used for hiding a curtain rod and creating a decorative appearance. In this regard, the present invention substantially fulfills this need.

SUMMARY OF THE INVENTION

In view of the foregoing disadvantages inherent in the known types of decorative cornices now present in the prior art, the present invention provides an improved cornice system. As such, the general purpose of the present invention, which will be described subsequently in greater detail, is to provide a new and improved cornice system and method which has all the advantages of the prior art and none of the disadvantages.

To attain this, the present invention essentially comprises a cornice system for hiding a curtain rod and creating a decorative appearance at window regions. The system comprises, in combination, a cornice box having a horizontally disposed upper panel and a vertically disposed forward panel and vertically disposed laterally spaced left and right side panels. Each panel is rectangular and has an exterior surface and an interior surface spaced by a thickness of between about 1.0 inches and 3.0 inches. The panels are fabricated of a generally rigid foam insulation board.

The upper panel has an inner edge positionable adjacent to a supporting wall and an outer edge positioned remote from the inner edge with a width of between about 6.0 inches and 18.0 inches. The upper panel has a left side edge and a right side edge between the inner and outer edges with a length between of between about 36.0 inches and 144.0 inches.

The forward panel has an upper edge positioned in a plane with the exterior surface of the upper panel with its interior surface in contact with the outer edge of the upper panel and with a width between of between about 9.0 inches and 19.0 inches. The forward panel has a left side edge and a right side edge between the upper and lower edges with a length between of between about 36.0 inches and 144.0 inches.

Each side panel has an inner edge positionable in contact with a supporting surface and an outer edge positioned remote from the inner edge in contact with the interior surface of the forward panel with a width of between about 6.0 inches and 18.0 inches. Each side panel has an upper edge in contact with the interior surface of the upper panel and a lower edge positioned remote from the upper edge and with a width of between about 6.0 inches and 18.0 inches.

A forward batting sheet has a width and length essentially equal to the exterior surface of the forward panel and is adhesively secured to the exterior surface of the forward panel. Two side batting sheets have a width and length essentially equal to the exterior surfaces of the side panels and are adhesively secured to the exterior surface of the side panels. The batting sheets are fabricated of a soft material between about 1.0 and 3.0 inches in thickness.

A fabric cover has a central section positionable over the forward batting sheet and end sections positionable over the side batting sheets. The fabric cover has a periphery sized to extend about 1.0 inches beyond the batting on all sides with fasteners positioned through the fabric cover adjacent to its periphery into the panels remote from the batting.

Curtains have lower extents depending beneath the cornice box adjacent to the side panels and a central extent constituting swag material festooned from the upper panel and hiding a portion of the fabric cover on the forward panel.

Depending adornments include laterally spaced openings formed in the upper panel adjacent to its front edge with fabric ribbons extending there through. The ribbons have free ends extending below the lower edge of the forward panel. A generally rigid cardboard tube has a diameter of between about 1 inch and 4 inches and a length essentially equal to the length of the forward panel. A fabric sleeve is positioned over the tube of a length greater than the tube whereby the sleeve on the tube may be shirred. The tube and sleeve are held in close proximity to the lower edge of the forward panel by the ribbons extending beneath the tube and sleeve adjacent the ends thereof.

Lastly provided are support brackets, each with a vertical leg below and a horizontal leg above. Horizontal fasteners extend through each vertical leg and vertical fasteners extending through each horizontal leg. The vertical fasteners extend into the interior surface of the upper panel and the horizontal fasteners extending into the a supporting surface in the form of a vertical wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cornice system which has all of the advantages of the prior art decorative cornices and none of the disadvantages.

It is another object of the present invention to provide a new and improved cornice system which may be easily and efficiently manufactured and marketed.

It is further object of the present invention to provide a new and improved cornice system which is of durable and reliable constructions.

An even further object of the present invention is to provide a new and improved cornice system which is susceptible of a low cost of manufacture with regard to both materials and labor, and which accordingly is then susceptible of low prices of sale to the consuming public, thereby making such cornice system economically available to the buying public.

Even still another object of the present invention is to provide a cornice system for hiding a curtain rod and creating a decorative appearance.

Lastly, it is an object of the present invention to provide a new and improved cornice system comprising, in combination, a cornice box having a horizontally disposed upper panel and a vertically disposed forward panel and vertically disposed laterally spaced left and right side panels, each panel being rectangular and having an exterior surface and an interior surface; and a fabric cover having a central section positionable over the exterior surface of the forward panel and end sections positionable over the exterior surfaces of the side panels, the fabric cover having a periphery sized to extend beyond the exterior surfaces of the front and side panels on all sides with fasteners positioned through the fabric cover adjacent to its periphery into the panels.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a cornice system constructed in accordance with the principles of the present invention.

FIG. 2 is a side elevational view taken along lone 2-2 of FIG. 1.

FIG. 5 is a cross sectional view taken along line 5-5 of FIG. 3.

FIG. 6 is a front elevational view similar to FIG. 1 but with the cornice system adorned with supplemental decorative fabric.

FIG. 7 is a front elevational view of a cornice system constructed in accordance with an alternate embodiment of the invention.

FIG. 8 is an exploded perspective view of the cornice system shown in FIG. 7.

The same reference numerals refer to the same parts throughout the various Figures.

DESCRIPTION OF THE PREFERRED EMBODIMENT

Figure 3:
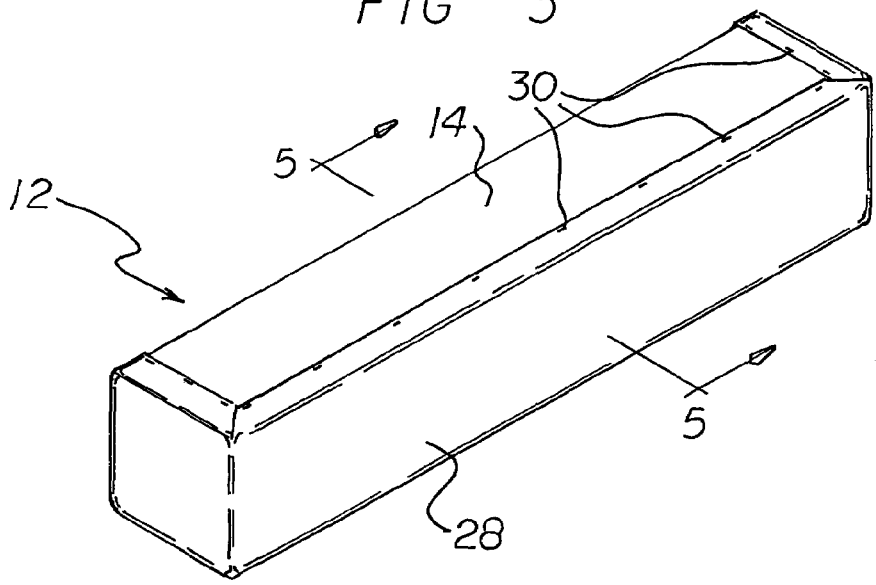
FIG. 3 is a perspective illustration of the cornice system shown in FIGS. 1 and 2.
Figure 4:
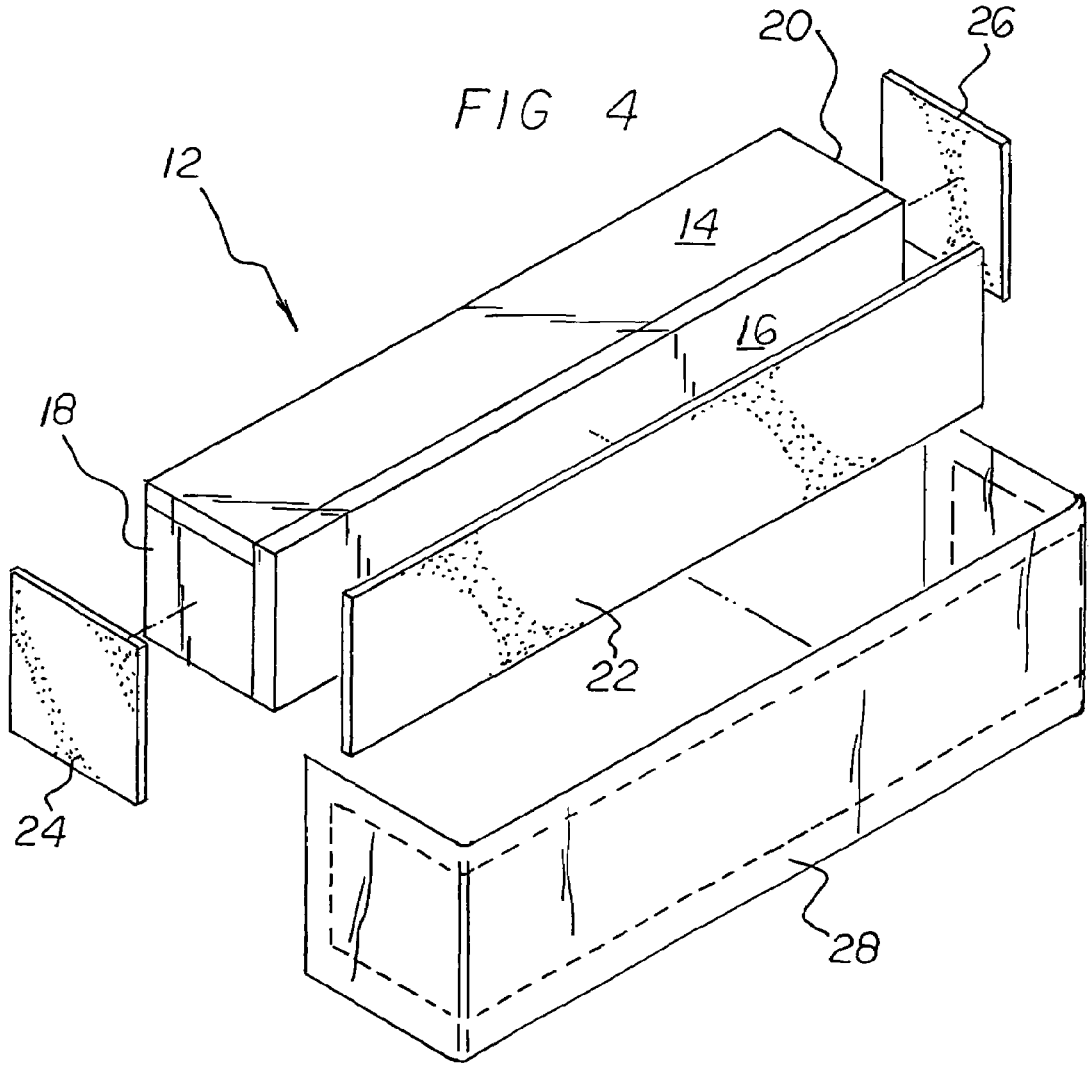
FIG. 4 is an exploded perspective view of the cornice system shown in FIG. 3.

With reference now to the drawings, and in particular to FIG. 1 thereof, the preferred embodiment of the new and improved cornice system embodying the principles and concepts of the present invention and generally designated by the reference numeral 10 will be described.

The present invention, the cornice system 10 is comprised of a plurality of components. Such components in their broadest context include a cornice box and a cover and depending adornments. Such components are individually configured and correlated with respect to each other so as to attain the desired objective.

The cornice system 10 of the present invention is for hiding a curtain rod and for creating a decorative appearance at window regions.

First provided is a cornice box 12. The cornice box has a horizontally disposed upper panel 14 and a vertically disposed forward panel 16 and vertically disposed laterally spaced left and right side panels 18, 20. Each panel is rectangular and has an exterior surface and an interior surface. Such interior and exterior surfaced are spaced by a thickness of between about 1.0 inches and 3.0 inches. The panels are preferably fabricated of a generally rigid foam insulation board which may be easily cut.

The upper panel 14 has an inner edge positionable adjacent to a supporting wall and an outer edge positioned remote from the inner edge. Between the inner and outer edges is a width of between about 6.0 inches and 18.0 inches. The upper panel has a left side edge and a right side edge between the inner and outer edge. Between the left and right side edges is a length between of between about 36.0 inches and 144.0 inches.

The forward panel 16 has an upper edge positioned in a plane with the exterior surface of the upper panel. Its interior surface is in contact with the outer edge of the upper panel. The forward panel has a width of between of between about 9.0 inches and 19.0 inches. The forward panel has a left side edge and a right side edge between the upper and lower edges with a length between of between about 36.0 inches and 144.0 inches between the side edges.

Each side panel 18, 20 has an inner edge positionable in contact with a supporting surface and an outer edge positioned remote from the inner edge. The outer edges are in contact with the interior surface of the forward panel. The side panels have a width of between about 6.0 inches and 18.0 inches. Each side panel has an upper edge in contact with the interior surface of the upper panel and a lower edge positioned remote from the upper edge. The side panels have a width of between about 6.0 inches and 18.0 inches.

Next provided is a forward batting sheet 22. Such batting sheet has a width and length essentially equal to the exterior surface of the forward panel. Such batting sheet is adhesively secured to the exterior surface of the forward panel. Additionally provided are two side batting sheets 24, 26. Each such side batting sheet has a width and length essentially equal to the exterior surfaces of the side panels. Such side batting sheets are adhesively secured to the exterior surface of the side panels. The batting sheets are fabricated of a soft material between about 1.0 and 3.0 inches in thickness.

A fabric cover 28 in next provided. Such fabric cover has a central section positionable over the forward batting sheet and end sections positionable over the side batting sheets. The fabric cover has a periphery sized to extend about 1.0 inches beyond the batting on all sides. Fasteners 30 are positioned through the fabric cover adjacent to its periphery into the panels remote from the batting. The fastener for the preferred embodiment is the T-pins having a first end formed with a point for piercing and coupling and a second end formed with a transverse cylinder for handling. The use of T-pins facilitates manipulation for easy changing of fabrics, colors, patterns and the like. Note FIGS. 3 and 5.

Curtains having lower extents 32 are next provided. Such lower extents depend beneath the cornice box adjacent to the side panels. A central extent 34 of the curtains constitute swag material festooned from the upper panel. Such central extents cover a portion of the fabric cover on the forward panel.

Provided next in an alternate embodiment of the invention are depending adornments 36. The depending ornaments have associated laterally spaced openings 38 formed in the upper panel adjacent to its front edge. Fabric ribbons 40, 42 extending through the spaced openings. The ribbons have free ends which extend below the lower edge of the forward panel. A generally rigid cardboard tube 44 has a diameter of between about 1 inch and 4 inches and a length essentially equal to the length of the forward panel. A fabric sleeve 46 is positioned over the tube. Such sleeve is preferably of a length greater than the tube whereby the sleeve on the tube may be shirred. The tube and sleeve are held in close proximity to the lower edge of the forward panel. The holding is achieved by the ribbons extending beneath the tube and sleeve adjacent the ends thereof.

The present invention, including the materials employed, provides for a light weight system for extended utility. One twelve foot cornice, for example, may be readily manipulated by one hand of an average person.

Lastly provided are support brackets 48. Each bracket has a vertical leg below and a horizontal leg above. Horizontal fasteners 50 extend through each vertical leg. Vertical fasteners 52 extend through each horizontal leg. The vertical fasteners extend into the interior surface of the upper panel. The horizontal fasteners extending into the a supporting surface in the form of a vertical wall 54.

Two brackets are illustrated in the disclosed preferred embodiment. Any number of brackets are adapted to be utilized as a function of the particular application. Similarly a wide variety of sizes and patterns and colors, mixed and matched may be utilized for the various components of the system as a function of the desire and taste of the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cornice system comprising, in combination:

a cornice box having a horizontally disposed upper panel and a vertically disposed forward panel and vertically disposed laterally spaced left and right side panels, each panel being rectangular and having an exterior surface and an interior surface;

a fabric cover having a central section positionable over the exterior surface of the forward panel and end sections positionable over the exterior surfaces of the side panels, the fabric cover having a periphery sized to extend beyond the exterior surfaces of the front and side panels on all sides with fasteners positioned through the fabric cover adjacent to its periphery into the panels; and depending adornments including laterally spaced openings formed in the upper panel adjacent to its front edge with fabric ribbons extending there through, the ribbons having free ends extending below the lower edge of the forward panel, a generally rigid cardboard tube having a diameter of between about 1 inch and 4 inches and a length essentially equal to the length of the forward panel with a fabric sleeve positioned over the tube of a length greater than the tube whereby the sleeve on the tube may be shirred, the tube and sleeve being held in close proximity to the lower edge of the forward panel by the ribbons extending beneath the tube and sleeve adjacent the ends thereof.

2. A cornice system for hiding a curtain rod and creating a decorative appearance at window regions comprising, in combination:

a cornice box having a horizontally disposed upper panel and a vertically disposed forward panel and vertically disposed laterally spaced left and right side panels, each panel being rectangular and having an exterior surface and an interior surface spaced by a thickness of between about 1.0 inches and 3.0 inches, the panels being fabricated of a generally rigid foam insulation board;

the upper panel having an inner edge positionable adjacent to a supporting wall and an outer edge positioned remote from the inner edge with a width of between about 6.0 inches and 18.0 inches, the upper panel having a left side edge and a right side edge between the inner and outer edges with a length between of between about 36.0 inches and 144.0 inches;

the forward panel having an upper edge positioned in a plane with the exterior surface of the upper panel with its interior surface in contact with the outer edge of the upper panel with a width between of between about 9.0 inches and 19.0 inches, the forward panel having a left side edge and a right side between the upper and lower edges with a length between of between about 36.0 inches and 144.0 inches;

each side panel having an inner edge positionable in contact with a supporting surface and an outer edge positioned remote from the inner edge in contact with the interior surface of the forward panel with a width of between about 6.0 inches and 18.0 inches, each side panel having an upper edge in contact with the interior surface of the upper panel and a lower edge positioned remote from the upper edge with a width of between about 6.0 inches and 18.0 inches;

a forward batting sheet having a width and length essentially equal to the exterior surface of the forward panel and adhesively secured to the exterior surface of the forward panel and two side batting sheets having a width and length essentially equal to the exterior surfaces of the side panels adhesively secured to the exterior surface of the side panels, the batting sheets being fabricated of a soft material between about 1.0 and 3.0 inches in thickness;

a fabric cover having a central section positionable over the forward batting sheet and end sections positionable over the side batting sheets, the fabric cover having a periphery sized to extend about 1.0 inches beyond the batting on all sides with fasteners positioned through the fabric cover adjacent to its periphery into the panels remote from the batting;

curtains having lower extents depending beneath the cornice box adjacent to the side panels and a central extent constituting swag material festooned from the upper panel and hiding a portion of the fabric cover on the forward panel;

depending adornments including laterally spaced openings formed in the upper panel adjacent to its front edge with fabric ribbons extending there through, the ribbons having free ends extending below the lower edge of the forward panel, a generally rigid cardboard tube having a diameter of between about 1 inch and 4 inches and a length essentially equal to the length of the forward panel with a fabric sleeve positioned over the tube of a length greater than the tube whereby the sleeve on the tube may be shirred, the tube and sleeve being held in close proximity to the lower edge of the forward panel by the ribbons extending beneath the tube and sleeve adjacent the ends thereof; and support brackets, each with a vertical leg below and a horizontal leg above, horizontal fasteners extending through each vertical leg and vertical fasteners extending through each horizontal leg, the vertical fasteners extending into the interior surface of the upper panel and the horizontal fasteners extending into the a supporting surface in the form of a vertical wall.

* * * * *